US011128947B2

(12) United States Patent
Darling

(10) Patent No.: US 11,128,947 B2
(45) Date of Patent: Sep. 21, 2021

(54) MODULAR LOUDSPEAKER SYSTEM

(71) Applicant: Henry Darling, Barnstaple (GB)

(72) Inventor: Henry Darling, Barnstaple (GB)

( * ) Notice: Subject to any disclaimer, the term of this patent is extended or adjusted under 35 U.S.C. 154(b) by 58 days.

(21) Appl. No.: 16/498,424

(22) PCT Filed: Mar. 28, 2018

(86) PCT No.: PCT/GB2018/050819

§ 371 (c)(1),
(2) Date: Sep. 27, 2019

(87) PCT Pub. No.: WO2018/178667

PCT Pub. Date: Oct. 4, 2018

(65) Prior Publication Data

US 2021/0092510 A1 Mar. 25, 2021

(30) Foreign Application Priority Data

Mar. 30, 2017 (GB) ..... 1705150

(51) Int. Cl.

| | |
|---|---|
| ***H04R 1/26*** | (2006.01) |
| ***H04R 1/02*** | (2006.01) |
| ***H04R 1/28*** | (2006.01) |
| ***H04R 27/00*** | (2006.01) |

(52) U.S. Cl.

CPC ..... *H04R 1/26* (2013.01); *H04R 1/025* (2013.01); *H04R 1/026* (2013.01); *H04R 1/2826* (2013.01); *H04R 1/2857* (2013.01); *H04R 27/00* (2013.01)

(58) Field of Classification Search

CPC ..... H04R 1/26; H04R 1/025; H04R 1/2826; H04R 1/026; H04R 1/2857; H04R 27/00

See application file for complete search history.

(56) References Cited

U.S. PATENT DOCUMENTS 3,898,384 A * 8/1975 Goeckel ..... H04R 1/2865 381/342
4,923,031 A * 5/1990 Carlson ..... H04R 1/2819 181/144
6,038,326 A * 3/2000 Czerwinski ..... H04R 1/26 181/152

(Continued)

FOREIGN PATENT DOCUMENTS

CN 1575031 A 2/2005
JP S61014590 U 1/1986

(Continued)

*Primary Examiner* — Oyesola C Ojo
(74) *Attorney, Agent, or Firm* — IP Attorneys Group; David Chen

(57) ABSTRACT

To provide flexibility in multiple loudspeaker combinations, and reduced space requirements, a modular loudspeaker system is provided comprising a first loudspeaker cabinet 10 having a first face 40, and a first loudspeaker 30 for producing sound, in use, to be emitted through the first face, the first loudspeaker cabinet including a first passage 50 arranged such that with a second loudspeaker cabinet 20, including a second loudspeaker 80, placed adjacent the first loudspeaker cabinet 10 the sound produced by the second loudspeaker 80, in use, travels through the first passage 50 to be emitted through the first face 40 of the first loudspeaker cabinet 10.

16 Claims, 6 Drawing Sheets

(56) References Cited

U.S. PATENT DOCUMENTS

| | | | | |
|---|---|---|---|---|
| 6,356,642 | B1 * | 3/2002 | Nakamura | H04R 1/02 181/144 |
| 7,760,899 | B1 * | 7/2010 | Graber | H04R 1/2842 381/341 |
| 8,526,655 | B2 * | 9/2013 | Dibb | H04R 1/025 381/345 |
| 10,250,967 | B2 * | 4/2019 | Lippitt | H04R 3/12 |
| 2004/0125974 | A1 * | 7/2004 | Kosatos | H04R 1/025 381/335 |
| 2011/0013782 | A1 * | 1/2011 | Moomey | H04R 1/403 381/87 |
| 2011/0019862 | A1 * | 1/2011 | Smith | H04R 1/26 381/386 |
| 2015/0071473 | A1 * | 3/2015 | Chick | H04R 1/40 381/337 |

FOREIGN PATENT DOCUMENTS

| | | | | | |
|---|---|---|---|---|---|
| JP | S63090391 | U | | 6/1988 | |
| JP | 2005086590 | A | | 3/2005 | |
| JP | 2006166302 | A | * | 6/2006 | H04R 1/02 |
| JP | 2006166302 | A | | 6/2006 | |

* cited by examiner

MODULAR LOUDSPEAKER SYSTEM

The present invention relates generally to a modular loudspeaker system and finds particular, although not exclusive, utility in loudspeaker systems used for events where emitted sound levels exceed 100 dB.

In such situations, many different loudspeakers cabinets are required to ensure the full frequency range of sound is emitted at a level which may be satisfactorily heard by the audience even at distance from the loudspeakers.

Such loudspeaker cabinets are typically stacked on top of, and adjacent, one another but these take up valuable stage space or require towers of loudspeaker cabinets to be built either side of the stage. One way to avoid this is to suspend a stack of loudspeaker cabinets but this requires further infrastructure which increases costs and set-up time, and still takes up space.

It is desirable to be able to provide multiple loudspeaker cabinets which can provide the full range of frequencies but which occupy less space and are simple to assemble and dismantle.

In a first aspect, the invention provides a modular loudspeaker system comprising a first loudspeaker cabinet having a first face and a first loudspeaker for producing sound, in use, to be emitted through the first face, the first loudspeaker cabinet including a first passage arranged such that with a second loudspeaker cabinet, including a second loudspeaker, placed adjacent the first loudspeaker cabinet the sound produced by the second loudspeaker, in use, travels through the first passage to be emitted through the first face of the first loudspeaker cabinet.

In this way, a second loudspeaker cabinet may be attached to the first loudspeaker cabinet in a tandem manner with the first loudspeaker cabinet in front and the second loudspeaker cabinet behind. The sound emitted from the second loudspeaker cabinet may travel through the first passage to the first face such that the sound from the first and second loudspeaker cabinet may be emitted from the same first face. In this way, the first and second loudspeaker cabinet may be arranged one behind another eliminating the need to stack the first and second loudspeaker cabinet on top of one another, or side-by-side.

The first face may be one or more openings in one side of the cabinet. The opening may extend across all of the one side. The first face may be a perforated side of the cabinet. The first face may include a cover such as a fabric shield, although other materials are contemplated.

One end of the first passage may extend from a side of the first loudspeaker cabinet different from the first face. For instance, it may extend from a face of the cabinet on the opposite side of the cabinet from the first face. The cross-sectional shape and/or area of the first passage may vary along its length. The longitudinal axis of the first passage may be rectilinear. Alternatively, it may include bends along its length.

The other end of the first passage may open onto the first face.

The first loudspeaker cabinet may further comprise a second passage arranged such that with a third loudspeaker cabinet, including a third loudspeaker, placed adjacent the first loudspeaker cabinet the sound produced by the third loudspeaker, in use, may travel through the second passage to be emitted through the first face of the first loudspeaker cabinet.

The modular loudspeaker may comprise a second loudspeaker cabinet including a second loudspeaker, arranged adjacent the first passage in the first loudspeaker cabinet.

The modular loudspeaker system may further comprise a third loudspeaker cabinet including a third loudspeaker, arranged adjacent the second passage in the first loudspeaker cabinet.

The loudspeaker cabinets may comprise box-like structures with at least one void in each in which the loudspeaker is arranged. Alternatively, the voids may be partitioned by the inclusion of partition walls.

The second loudspeaker cabinet may comprise a third passage arranged such that with a third loudspeaker cabinet, including a third loudspeaker, placed adjacent the second loudspeaker cabinet the sound produced by the third loudspeaker, in use, may travel through the third passage and either the first and/or second passages to be emitted through the first face of the first loudspeaker cabinet.

The second loudspeaker cabinet may include a fourth passage arranged to transmit sound from the second loudspeaker to an opening in the outside surface of the second loudspeaker cabinet, the position of the opening being aligned with an end of the first passage in the first loudspeaker cabinet with the first and second speaker cabinets adjacent one another.

Alternatively, rather than a fourth passage the second loudspeaker may be arranged at, or adjacent, a front face of the second loudspeaker cabinet. In this respect, the area of the front face of the second loudspeaker cabinet adjacent the second loudspeaker may be substantially open.

The third loudspeaker cabinet may include a fifth passage arranged to transmit sound from the third loudspeaker to an opening in the outside surface of the third loudspeaker cabinet, the position of the opening being aligned with an end of the first passage in the first loudspeaker cabinet with the first and second speaker cabinets adjacent one another, or aligned with an end of the third passage in the second loudspeaker cabinet with the second and third speaker cabinets adjacent one another.

The first loudspeaker cabinet may include a sixth passage through which sound emitted from the first loudspeaker travels, in use, to reach the first face. This arrangement may be employed where the first loudspeaker is not set at or adjacent the first face but is set back therefrom.

Any one of the loudspeaker cabinets may include a reflex port. The reflex ports may allow sound from the rear of any loudspeaker to exit the loudspeaker cabinet via an opening. These allow sound emitted from the rear of the loudspeakers to exit the loudspeaker cabinet directly without having to pass through any wall. Their design (shape, size) may be used to tune the chamber formed by the cabinet, in which the back of the loudspeaker sits.

The reflex port of the first loudspeaker cabinet may be arranged on the first face. However, other arrangements such as being arranged on another side of the loudspeaker cabinet are contemplated.

The reflex port of the second loudspeaker cabinet may be arranged to be unimpeded by the first loudspeaker cabinet with the first and second speaker cabinets adjacent one another. In other words, the port may be located on a surface of the second loudspeaker cabinet such that with the first loudspeaker cabinet attached to the second loudspeaker cabinet the first loudspeaker cabinet does not block the port.

However, the reflex port of the second loudspeaker cabinet may still be arranged on the same side of the cabinet as one end of the second passage. The port is not blocked in such a situation because the first loudspeaker cabinet may not extend in front of the port. This may be because the second loudspeaker cabinet has a surface, which is immediately adjacent a surface of the first loudspeaker cabinet with the two attached together, being larger than the said surface of the first loudspeaker cabinet.

The reflex port of the second loudspeaker cabinet may be arranged on the same side of the cabinet as the opening of the fourth passage.

The reflex port of the first loudspeaker cabinet may be arranged on the first face.

The loudspeaker cabinets may include attachment means for releasably attaching them together. These typically include a loop portion and a hook portion, with one of the hook and loop being located on one of the two loudspeaker cabinets and the other of the hook and loop portions being located on the other of the two loudspeaker cabinets. Other types of attachment means are contemplated.

The attachment means may include case clasps. The attachment means may include two cooperating parts, one part arranged on each of the first and second loudspeaker cabinets.

Both first and second loudspeaker cabinets may include a pair of attachment means, arranged such that the distance between them on each cabinet is the same.

The system contemplates many different size and shape loudspeaker cabinets; however, each may include two attachment means spaced apart the same distance such that various combinations of loudspeaker cabinets may be attached to one another.

It is contemplated that several different first, second, third and possibly more loudspeaker cabinets will be produced, each having a unique size and shape selected on the basis of the loudspeaker to be used, the frequency desired, the application, and other characteristics of the sound to be emitted.

In this regard, the location of the inlet to the first passage on each first loudspeaker cabinet may have the same position relative to the attachment means such that various first and second loudspeaker cabinets may be aligned correctly so that, in use, the sound emitted from the second loudspeaker cabinet will reach the first face of the first loudspeaker cabinet via the first passage.

Likewise, the location of one end of the second passage on each second loudspeaker cabinet, adapted to be attached behind a first loudspeaker cabinet, may have the same position relative to the attachment means such that various first and second loudspeaker cabinets may be aligned correctly so that, in use, the sound emitted from the second loudspeaker cabinet will reach the first face of the first loudspeaker cabinet via the first passage.

The modular loudspeaker system may comprise two first loudspeaker cabinets and two second loudspeaker cabinets, wherein the loudspeaker cabinets include attachment means for releasably attaching them all together, with the two first loudspeaker cabinets side-by-side and the two second loudspeaker cabinets side-by-side adjacent the two first loudspeaker cabinets.

The two first passages of the two first loudspeaker cabinets may be arranged at or towards the centre of the two side-by-side first loudspeaker cabinets.

Likewise, the system may include more than two of either first and second loudspeaker cabinets, or indeed more than one third or fourth loudspeaker cabinets.

The cross-sectional shape and/or area of any of the passages may vary along their length. The longitudinal axis of the passages may be rectilinear. Alternatively, they may include bends along their length.

The modular loudspeaker system may further comprise blanking means for releasably blocking off an end of any of the first, second, third, or fourth passages. Such blanking means may be a hinged or slidable flap, or plate, or may be an entire removable and replaceable wall of the cabinet.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
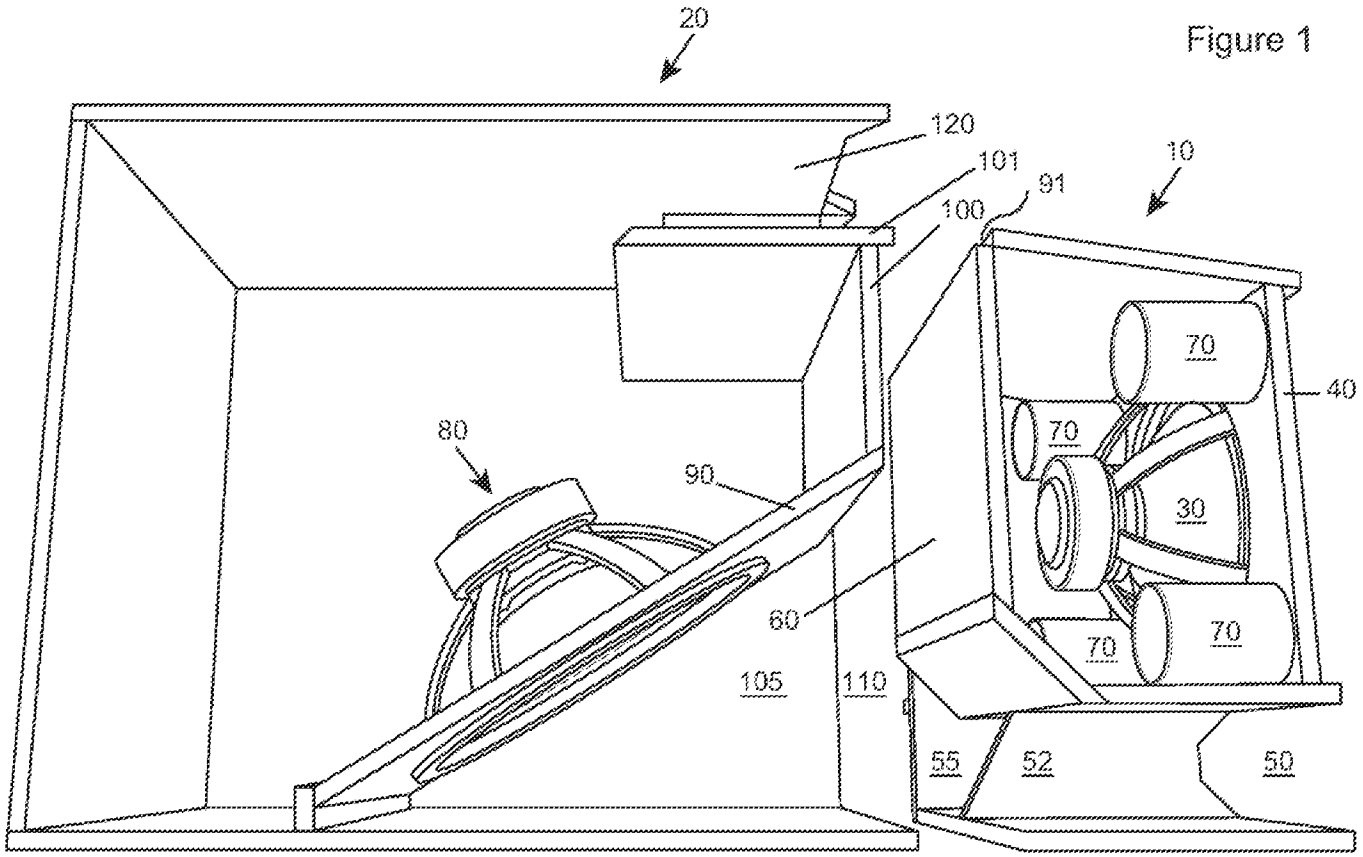
FIG. 1 is a perspective view of a modular loudspeaker system with unattached loudspeaker cabinets.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means.

"Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

In FIG. 1 a first loudspeaker cabinet 10 is shown separately and to the right of a second loudspeaker cabinet 20. The first loudspeaker cabinet 10 includes four side walls and a base forming a box-like void within which a loudspeaker 30 is arranged such that its diaphragm is located projecting through a hole in the front side wall 40 (first face). Four reflex ports 70 are arranged symmetrically around the loudspeaker 30 each comprised of a hollow pipe extending partially into the void from holes cut into the front side wall 40. The front side wall 40 may be considered to be a baffle. To one side of the box-like structure a first passage 50 is arranged extending from the front side (first face) 40 to the rear side 60. The passage 50 is open at both ends. The passage 50 is split into two by the presence of a horizontal bracing member 52 arranged substantially parallel to the base of the first loudspeaker cabinet 10.

The first loudspeaker cabinet 10 is shown with its upper side (lid) removed to improve the understanding thereof.

A second loudspeaker cabinet 20 is shown behind the rear side 60 of the first loudspeaker cabinet 10. It comprises a box-like structure formed of four sides and a base. A front side 100 is shown adjacent the rear side 60 of the first loudspeaker cabinet 10. A loudspeaker 80 is arranged in an internal wall 90 (also known as a baffle) arranged between the front side 100 and one of the side walls such that the plane of the front of its diaphragm lies at an angle of approximately 45 degrees to the plane of the front side 100. The front side 100 includes a hole 110 allowing sound from the loudspeaker 80 to pass out of the second loudspeaker cabinet 20.

A reflex port 120 is arranged within the front side 100. A short passage extends into the void of the box-like structure from this port 120.

As the loudspeaker 80 is set back from the front side 100 a passage 105 is formed in front of it extending to the front side 100. This passage 105 is bounded by the wall 90 in which the loudspeaker 80 is arranged, part of one of the adjacent side walls and part of the base and upper side/lid (not shown to improve the understanding of the cabinet). It is shown open at its end which lies in the front side 100.

A projection 101 is arranged on the front side 100 adjacent the reflex port 120. This projection 101 fits into a recess 91 provided on the rear side 60 of the first loudspeaker cabinet 10, when the two cabinets are attached together. These help locate the two cabinets together during attachment of one to another.

Figure 2:
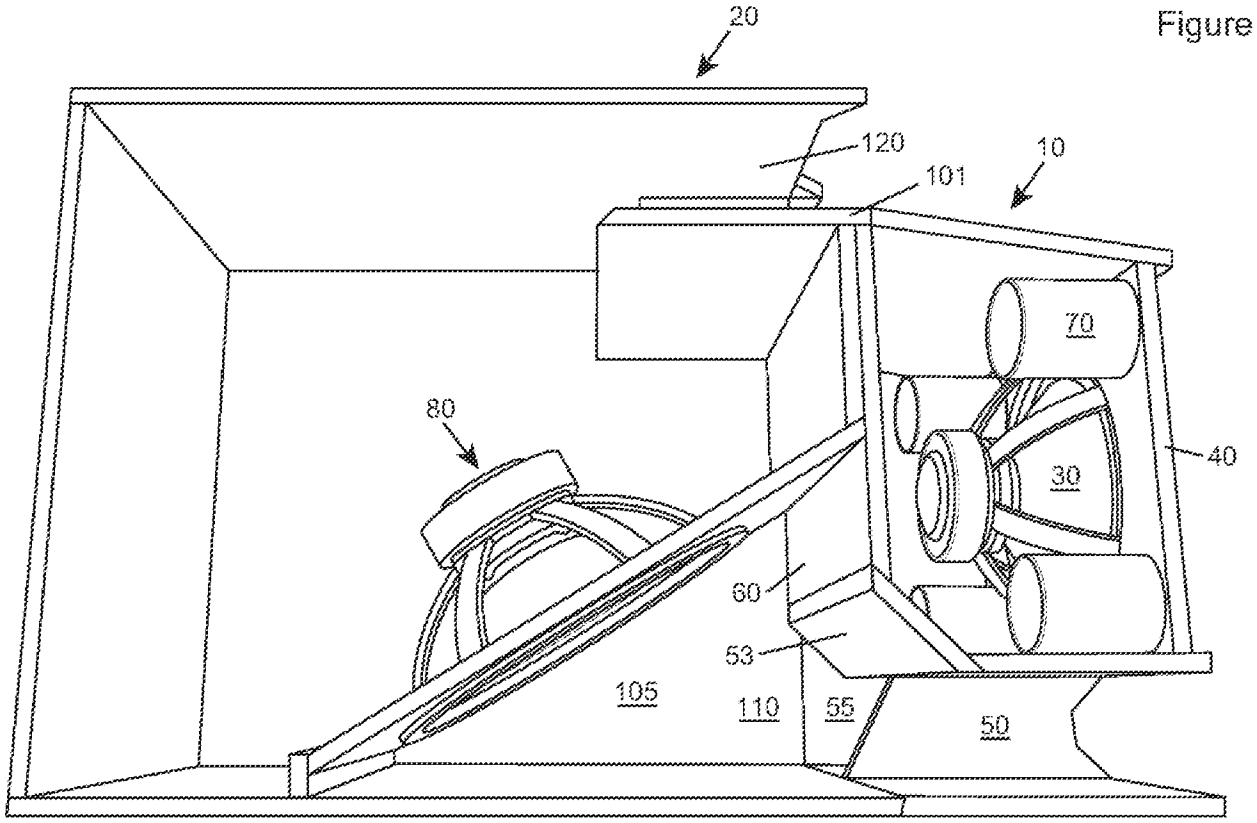
FIG. 2 is a perspective view of the modular loudspeaker system of FIG. 1 with loudspeaker cabinets attached.

In FIG. 2, the two loudspeaker cabinets are shown attached together. It is to be noted that the hole 110 in the front side 100 of the second loudspeaker cabinet is larger than the inlet 55 to the first passage in the first loudspeaker cabinet 10. Furthermore, a portion of wall 53 is provided in the first loudspeaker cabinet 10 which is arranged such that its major plane lies at approximately 45 degrees to the plane of the rear side 60. This wall 53 acts to funnel the sounds emitted from the second passage 105 of the second loudspeaker cabinet 20 into the first passage 50 of the first loudspeaker cabinet 10. It also may act to tune the first passage 50.

It is to be noted that the reflex port 120 of the second loudspeaker cabinet 20 is unobstructed by the first loudspeaker cabinet 10.

The second loudspeaker cabinet may be a "reflex sub" on its own but a "6th order band-pass sub" when in combination with the first loudspeaker cabinet.

Figure 3:
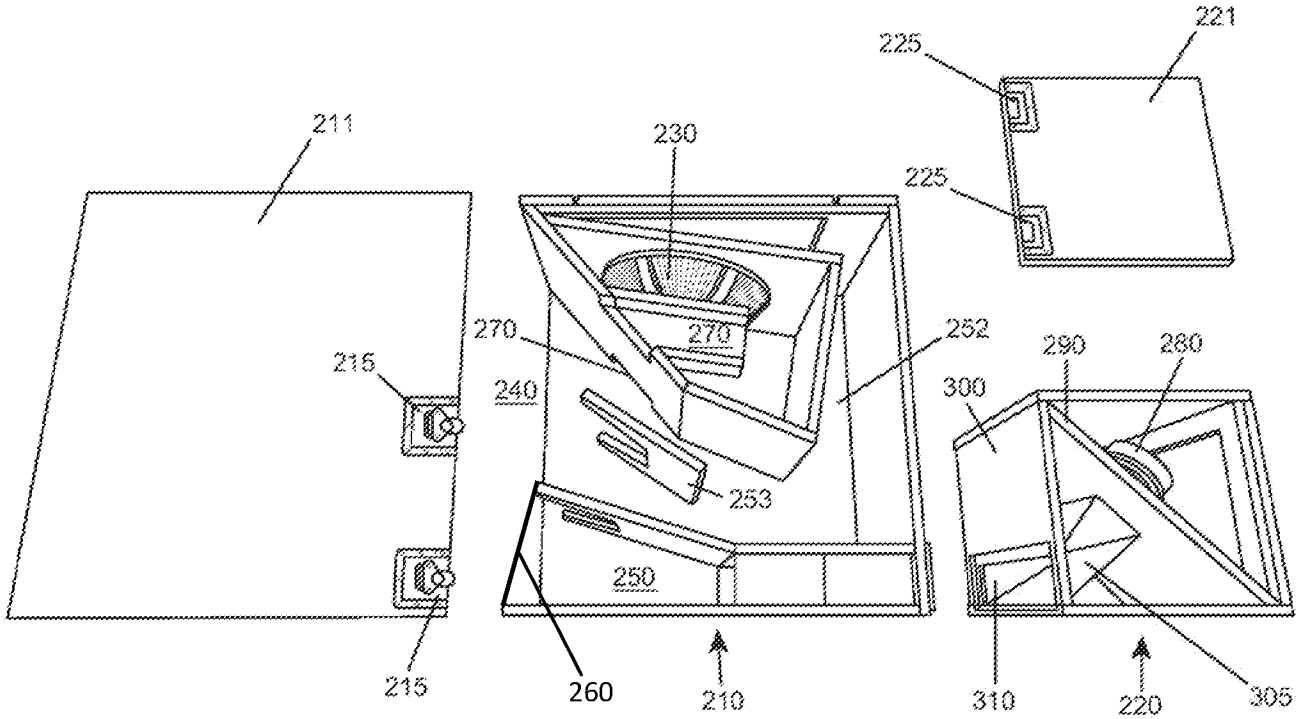
FIG. 3 is a perspective view of another modular loudspeaker system with unattached loudspeaker cabinets.

In FIG. 3, an alternative arrangement of first 210 and second 220 loudspeaker cabinets is shown. Again, both loudspeaker cabinets have box-like structures. The figure shows both loudspeaker cabinets with their lids 211, 221 removed to improve the understanding thereof. The first loudspeaker cabinet 210 includes a loudspeaker 230 arranged in a baffle such that its diaphragm points towards an interior surface of one of the side walls of the loudspeaker cabinet. A third passage 252 extends from the loudspeaker 230 in a spiral-like manner until it reaches the first face 240 of the loudspeaker cabinet. A divider wall 253 splits the third passage near the first face 240. This divider wall may act to strengthen the loudspeaker cabinet.

The loudspeaker 230 is arranged such that its driver and rear portion of the diaphragm is substantially enclosed in a housing. Two reflex ports 270 are arranged extending from this housing towards the first face 240.

A first passage 250 is arranged to one side of the loudspeaker cabinet 210. It leads from an opening in the rear side of the first loudspeaker cabinet towards the first face 240. The passage 250 widens as it nears the first face 240. The first passage 250 includes a blanking means 260 for releasably blocking off the end of the passage 250.

The second loudspeaker cabinet 220 has a loudspeaker 280 supported by an internal wall or baffle 290 which major plane is arranged at approximately 45 degrees to the front side 300 of the second loudspeaker cabinet 220. A second passage 305 leads from the front of the loudspeaker 280 to a hole 310 provided in the front side 300 of the second loudspeaker cabinet 220. This second passage 305 has a substantially uniform rectangular cross-section along its axial length.

With the two loudspeaker cabinets attached together the hole 310 aligns with the hole in the rear of the first loudspeaker cabinet 210 such that in use sounds emitted from the loudspeaker in the second loudspeaker cabinet will reach the first face 240 via the first 250 and second 305 passages. No reflex ports are shown for the second loudspeaker cabinet 220 although ports may be included.

On each lid 211, 221 attachment means 215, 225 are shown. The attachment means 215 on the first loudspeaker cabinet are engageable with the attachment means 225 on the second loudspeaker cabinet by manual manipulation.

Figure 4:
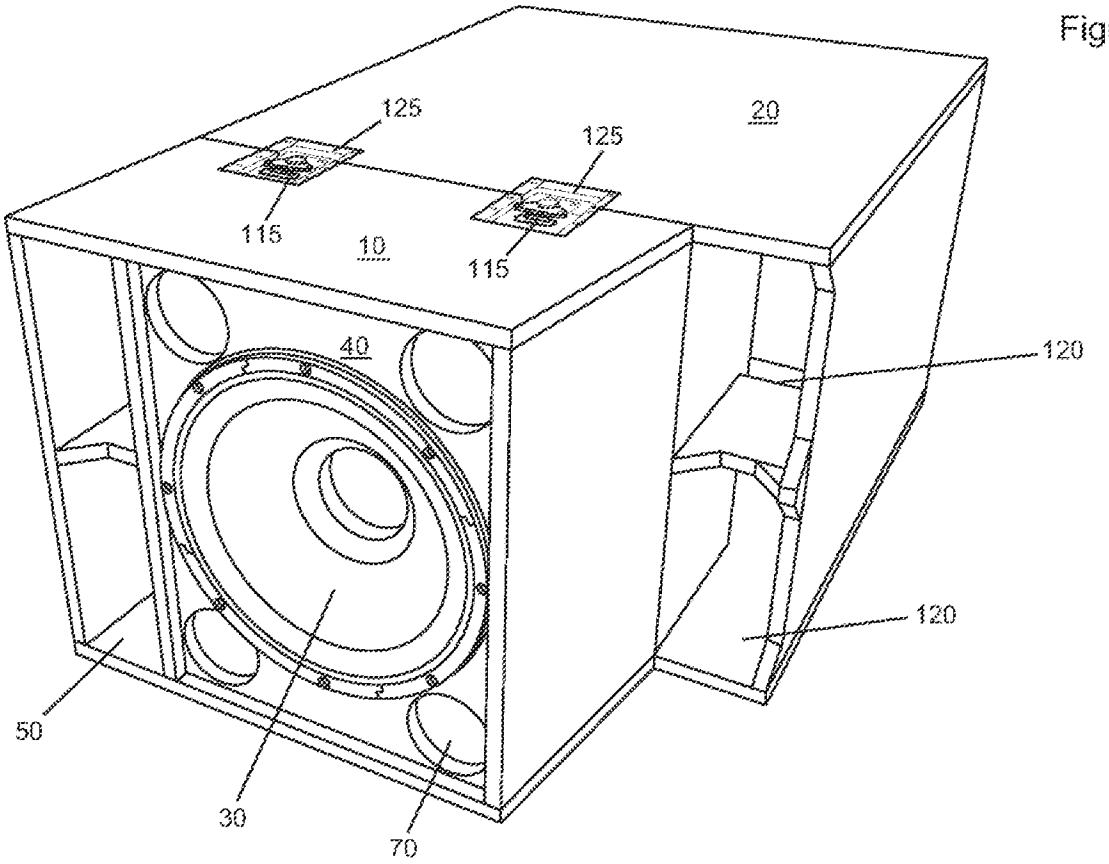
FIG. 4 is an alternative perspective view of the modular loudspeaker system of FIG. 2.

FIG. 4 shows a perspective view of the two loudspeaker cabinets in FIG. 2 from above and to the right of the front of the first loudspeaker cabinet 10. The loudspeaker 30 in the first loudspeaker cabinet 10 is visible on the front first side 40. The four reflex ports 70 for the loudspeaker in the first loudspeaker cabinet 10 are also visible in a symmetrical arrangement around the diaphragm of the loudspeaker. The outlet of the first passage 50 is visible to the left of the loudspeaker. Furthermore, the reflex port 120 from the loudspeaker in the second loudspeaker cabinet 20 are visible to the right of the first face 40.

On top, the attachment means 115, 125 inter-engaged with one another are visible.

Figure 5:
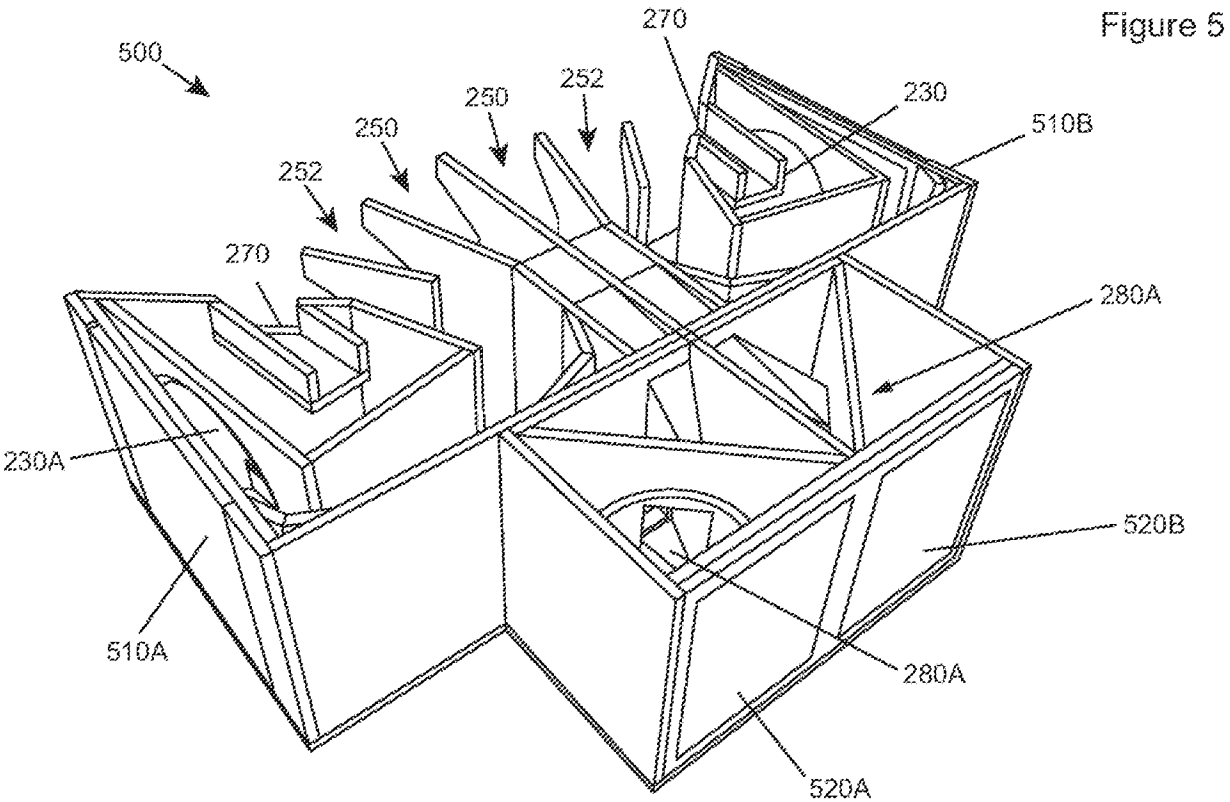
FIG. 5 is a perspective view of yet another modular loudspeaker system with attached loudspeaker cabinets.

FIG. 5 shows an arrangement 500 of two first loudspeaker cabinets 510A, 5106 and two second loudspeaker cabinets 520A, 520B. All have their upper sides (lids) removed for clarity purposes. The two first loudspeaker cabinets are attached together and the two second loudspeaker cabinets are attached to the first two loudspeaker cabinets. The type of loudspeaker cabinets are similar to the ones described with regard to FIG. 3.

The front faces of the two first loudspeaker cabinets 510A, 5106 include outlets of the first passages 250, the second passages 252 and the reflex ports 270.

The loudspeakers are not shown in this figure but the holes 230A, 280A in their respective baffles for receipt of such loudspeakers are shown in each of the loudspeaker cabinets.

It is to be noted that the arrangement 500 is symmetrical about an axis passing through form the front to the rear between the two adjacent two first and two second loudspeaker cabinets. In other words, the first 5106 and second 520B loudspeaker cabinet on the right are inverted by 180 degrees as compared to the first 510A loudspeaker cabinet and second 520A loudspeaker cabinet on the left such that the loudspeakers of the two first loudspeaker cabinets 510A, 510B would each face outwardly in substantially opposite directions.

Figure 6:
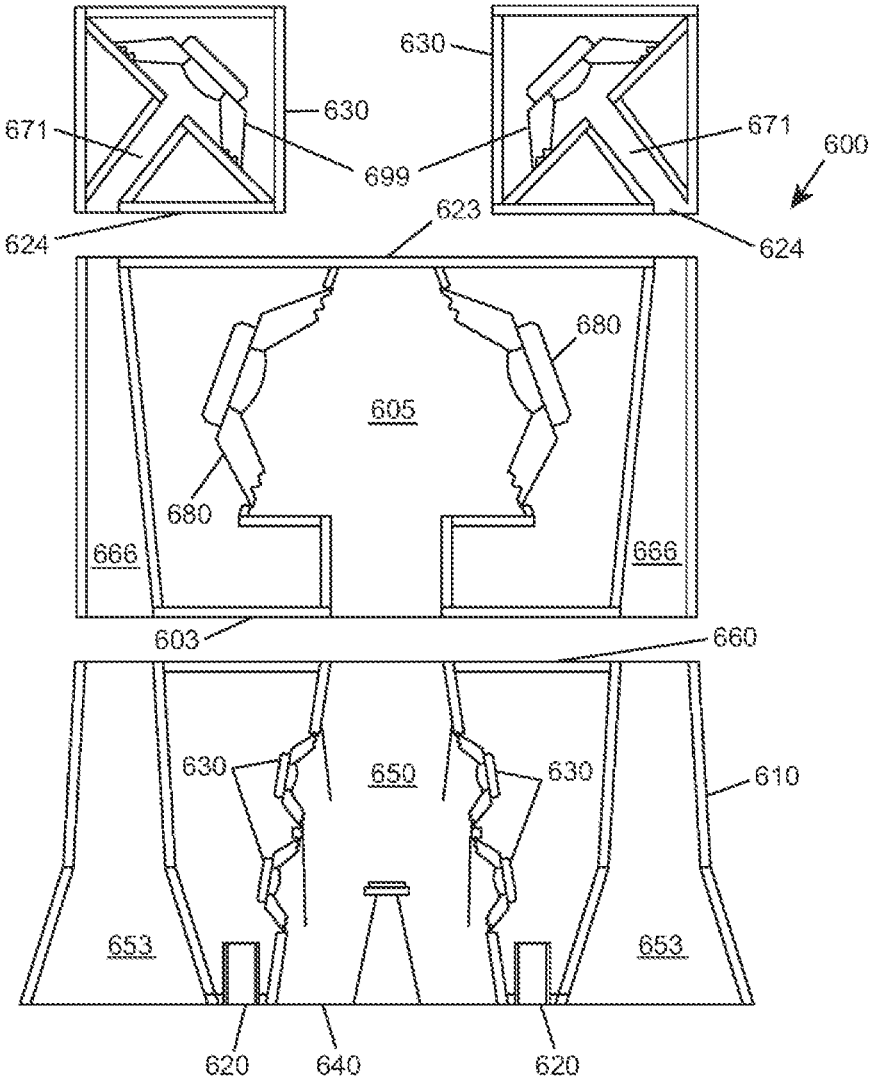
FIG. 6 is a plan view of a different modular loudspeaker system.

FIG. 6 shows an alternative modular loudspeaker cabinet system 600 comprising several loudspeaker cabinets 610, 620, 630. They are not shown attached to one another, however, it is to be understood that they are in a similar general arrangement as when attached together such that there are no gaps between each adjacent loudspeaker cabinet.

The first loudspeaker cabinet 610 has a front wall 640. Within this cabinet four loudspeakers 630 are arranged, two either side of a central passage 650 which extends from the front wall 640 to the back wall 660 and is open at both ends with an aperture provided in the back 660 and front 640 walls. The sound, in use, emitted from the front of these loudspeakers 630 travels through this central passage 650 to reach the front wall (first face) 640 of the cabinet and thus be emitted to an audience.

Two reflex ports 620 are provided on the front wall 640, one each side of the central passage 650. These reflex ports allow sound from the rear of the loudspeakers 630 to exit the cabinet and be heard by the audience situated in front of the modular system 600.

The first loudspeaker cabinet 610 also includes two passages 653, located one each side of the loudspeaker cabinet 610 between the rear of the loudspeakers 630 and the side walls of the loudspeaker cabinet 610. These passages 653 extend from the back wall 660 to the front wall 640 and are open at both ends with apertures provided in the back 660 and front 640 walls.

Also depicted is a second loudspeaker cabinet 620. This has two loudspeakers 680 arranged within it either side of a central passage 605 which extends from the back wall 623 to the front wall 603. In use sound emitted from the front of the two loudspeakers 680 travels to the front wall 603 via the central passage 605. The central passage 605 is aligned with the first 610 and second 620 loudspeaker cabinets attached together such that, in use, sound from the loudspeakers 680 in the second loudspeaker cabinet 620 will travel through the central passage 605 of the second loudspeaker cabinet 620 and then through the central passage 650 of the first loudspeaker cabinet 610.

The second loudspeaker cabinet 620 also includes two passages 666, located one each side of the loudspeaker cabinet 620 between the rear of the loudspeakers 680 and the side walls of the loudspeaker cabinet 620. These passages 666 extend from the back wall 623 to the front wall 603 and are open at both ends with apertures provided in the back 623 and front 603 walls.

The point at which the end of each passage 666 opens onto the front wall 603 of the second loudspeaker cabinet 620 is arranged such that they are aligned with the point at which each passage 653 opens onto the rear wall 660 of the first loudspeaker cabinet 610 with the first and second loudspeaker cabinets attached together.

At the rear of the second loudspeaker cabinet 620 two third loudspeaker cabinets 630 are provided. These third loudspeaker cabinets are smaller than the second loudspeaker cabinet 620 such that they can both fit side-by-side each other behind the back wall 623 of the second loudspeaker cabinet 620.

Each third loudspeaker cabinet 630 includes a loudspeaker 699. A passage 671 leads from the front of each loudspeaker 699 to the front wall 624 of each loudspeaker cabinet 630. The position of the point on the front wall 624 of each third loudspeaker cabinet 630 where the passage 671 opens is arranged such that it may be aligned with the opening of each of the passages 666 on the rear wall 623 of the second loudspeaker cabinet 620.

In this manner, when in use, sound emitted from the loudspeakers 699 in the third loudspeaker cabinets 603 may reach the front wall 640 of the first loudspeaker cabinet 610 via the passages 671, 666, 653.

Although not shown the second and/or third loudspeaker cabinets may also include reflex ports.

Although the first 610 and second 620 loudspeaker cabinets are shown as single cabinets it is contemplated that they may be two cabinets each, releasably attachable to one another.

The first 610, second 620 and third 630 loudspeaker cabinets may have approximately the same height. However, it is also contemplated that any one or more of the first, second or third loudspeaker cabinets may have a height half the maximum height of the other loudspeaker cabinets. In this way two layers of that half-height loudspeaker cabinet may be provided. The passages 653, 666, 671, 605, 650 may be altered as necessary to ensure a continuous path for sound emitted by any loudspeaker 630, 680, 699 to reach the front wall 640.

In use, it may be desirable to include a gasket between adjacent loudspeaker cabinets to help seal them together to eliminate sound loss at the junctions. Rubber gaskets are contemplated.

With regard to the figures it is to be understood that certain features are not included to improve their clarity. For instance, no wiring is show, nor any acoustic foam or the like.

The invention claimed is:

1. A modular loudspeaker system comprising a first loudspeaker cabinet having a first face and a first loudspeaker for producing sound, in use, to be emitted through the first face, the modular loudspeaker system further comprising a second loudspeaker cabinet including a second loudspeaker, the second loudspeaker cabinet arranged behind the first loudspeaker cabinet, the first loudspeaker cabinet including a first passage arranged such that the sound produced by the second loudspeaker, in use, travels through the first passage to be emitted through the first face of the first loudspeaker cabinet, wherein the second loudspeaker cabinet includes a fourth passage arranged to transmit sound from the second loudspeaker to an opening in the outside surface of the second loudspeaker cabinet, the position of the opening being aligned with an end of the first passage in the first loudspeaker cabinet when the first and second speaker cabinets are adjacent one another.

2. The modular loudspeaker system of claim 1, wherein the first loudspeaker cabinet further comprises a second passage arranged such that with a third loudspeaker cabinet, including a third loudspeaker, placed adjacent the first loudspeaker cabinet the sound produced by the third loudspeaker, in use, travels through the second passage to be emitted through the first face of the first loudspeaker cabinet.

3. The modular loudspeaker system of claim 2, further comprising a third loudspeaker cabinet including a third loudspeaker, arranged adjacent the second passage in the first loudspeaker cabinet.

4. The modular loudspeaker system of claim 1, wherein the second loudspeaker cabinet comprises a third passage arranged such that with a third loudspeaker cabinet, including a third loudspeaker, placed adjacent the second loudspeaker cabinet the sound produced by the third loudspeaker, in use, travels through the third passage and either the first and/or second passages to be emitted through the first face of the first loudspeaker cabinet.

5. The modular loudspeaker system of claim 3, wherein the third loudspeaker cabinet includes a fifth passage arranged to transmit sound from the third loudspeaker to an opening in the outside surface of the third loudspeaker cabinet, the position of the opening being aligned with an end of the first passage in the first loudspeaker cabinet when the first and second speaker cabinets are adjacent one another, or aligned with an end of the third passage in the second loudspeaker cabinet when the second and third speaker cabinets are adjacent one another.

6. The modular loudspeaker system of claim 1, wherein any one of the loudspeaker cabinets include a reflex port.

7. The modular loudspeaker system according to claim 6, wherein the reflex port of the second loudspeaker cabinet is arranged to be unimpeded by the first loudspeaker cabinet when the first and second speaker cabinets are adjacent one another.

8. The modular loudspeaker system according to claim 6, wherein the reflex port of the first loudspeaker cabinet is arranged on the first face.

9. The modular loudspeaker system of claim 1, wherein the loudspeaker cabinets include attachment means for releasably attaching them together.

10. The modular loudspeaker system according to claim 9, wherein the attachment means include case clasps.

11. The modular loudspeaker system according to claim 9, wherein the attachment means includes two cooperating parts, one part arranged on each of the first and second loudspeaker cabinets.

12. The modular loudspeaker system according to claim 9, wherein both first and second loudspeaker cabinets include a pair of attachment means, arranged such that the distance between them on each cabinet is the same.

13. The modular loudspeaker system according to claim 1, comprising two first loudspeaker cabinets and two second loudspeaker cabinets, wherein the loudspeaker cabinets include attachment means for releasably attaching them all together, with the two first loudspeaker cabinets side-by-side and the two second loudspeaker cabinets side-by-side adjacent the two first loudspeaker cabinets.

14. The modular loudspeaker system according to claim 13, wherein the two first passages of the two first loudspeaker cabinets are arranged at or towards the centre of the two side-by-side first loudspeaker cabinets.

15. The modular loudspeaker system of claim 1, further comprising blanking means for releasably blocking off an end of any of the first, second, third, or fourth passages.

16. A modular loudspeaker system comprising a first loudspeaker cabinet having a first face and a first loudspeaker for producing sound, in use, to be emitted through the first face, the modular loudspeaker system further comprising a second loudspeaker cabinet including a second loudspeaker, the second loudspeaker cabinet arranged behind the first loudspeaker cabinet, the first loudspeaker cabinet including a first passage arranged such that the sound produced by the second loudspeaker, in use, travels through the first passage to be emitted through the first face of the first loudspeaker cabinet, wherein the second loudspeaker cabinet includes a fourth passage arranged to transmit sound from the second loudspeaker to an opening in the outside surface of the second loudspeaker cabinet, the position of the opening being aligned with an end of the first passage in the first loudspeaker cabinet when the first and second speaker cabinets are adjacent one another, the modular loudspeaker system further comprising a third loudspeaker cabinet including a third loudspeaker, the first loudspeaker cabinet further comprising a second passage arranged such that with the third loudspeaker cabinet placed adjacent the first loudspeaker cabinet the sound produced by the third loudspeaker, in use, travels through the second passage to be emitted through the first face of the first loudspeaker cabinet.

* * * * *